US009918896B2

(12) United States Patent
Tsang

(10) Patent No.: US 9,918,896 B2
(45) Date of Patent: Mar. 20, 2018

(54) FOOTBATH APPARATUS

(71) Applicant: FKA Distributing Co., LLC, Commerce Township, MI (US)

(72) Inventor: Hing Wah Tsang, Ajax (CA)

(73) Assignee: FKA Distributing Co., LLC, Commerce Township, MI (US)

( * ) Notice: Subject to any disclaimer, the term of this patent is extended or adjusted under 35 U.S.C. 154(b) by 0 days.

(21) Appl. No.: 15/001,798

(22) Filed: Jan. 20, 2016

(65) Prior Publication Data

US 2017/0202736 A1 Jul. 20, 2017

(51) Int. Cl.

| | |
|---|---|
| ***A61H 33/02*** | (2006.01) |
| ***A47K 3/022*** | (2006.01) |
| ***A61H 33/00*** | (2006.01) |
| ***A61H 23/00*** | (2006.01) |

(52) U.S. Cl.

CPC ..... *A61H 33/028* (2013.01); *A47K 3/022* (2013.01); *A61H 23/00* (2013.01); *A61H 33/0095* (2013.01); *A61H 33/026* (2013.01); *A61H 33/6005* (2013.01)

(58) Field of Classification Search

CPC ..... A47K 3/06; A47K 3/062; A47K 3/064; A47K 3/07; A47K 3/074; A47K 1/02; A61H 33/028

See application file for complete search history.

(56) References Cited

U.S. PATENT DOCUMENTS

| | | | | |
|---|---|---|---|---|
| 164,423 | A * | 6/1875 | Chamberlain | A47K 3/06 4/585 |
| 3,306,329 | A * | 2/1967 | Braun | B65D 7/26 220/756 |
| 4,046,277 | A | 9/1977 | Morrison | |
| 5,349,708 | A * | 9/1994 | Lee | A47B 77/06 4/631 |
| 6,385,795 | B1 | 5/2002 | Ferber et al. | |
| 6,393,633 | B2 | 5/2002 | Ferber | |
| 6,438,768 | B1 | 8/2002 | Yen | |
| D463,030 | S | 9/2002 | Ferber | |
| 6,505,358 | B2 | 1/2003 | Ferber et al. | |

(Continued)

FOREIGN PATENT DOCUMENTS

| | | |
|---|---|---|
| CN | 104287662 A | 1/2015 |
| CN | 204158287 U | 2/2015 |

(Continued)

OTHER PUBLICATIONS

Wikipedia, "Lavipeditum", Jun. 10, 2013, 2 pages.

International Search Report and Written Opinion for Application No. PCT/US2017/014036, dated Apr. 27, 2017, 14 pages.

*Primary Examiner* — Janie Loeppke

(74) *Attorney, Agent, or Firm* — Brooks Kushman P.C.

(57) ABSTRACT

A footbath has a base member defining a platform. A flexible continuous side wall extends from a proximal end region connected about a periphery of the base member to a distal end region. The side wall has a collapsed position and an extended position. The platform of the base member and the side wall cooperate to define a bath chamber for retaining water with the bath chamber sized to receive a body part. A retention member is supported by the base member to extend from the base member to the distal end region of the side wall to retain the side wall in the extended position.

20 Claims, 3 Drawing Sheets

(56) References Cited

U.S. PATENT DOCUMENTS

| | | | | |
|---|---|---|---|---|
| D471,638 | S | 3/2003 | Ferber | |
| 6,568,000 | B1 | 5/2003 | Kaufman et al. | |
| 6,725,471 | B2 | 4/2004 | Ferber et al. | |
| 6,973,683 | B2 | 12/2005 | Lev et al. | |
| 7,100,220 | B2 | 9/2006 | Lev et al. | |
| 7,380,294 | B2 | 6/2008 | Lev et al. | |
| 7,426,757 | B2 | 9/2008 | Lev et al. | |
| 7,900,296 | B2 | 3/2011 | Lev et al. | |
| 8,407,826 | B2 | 4/2013 | Lev et al. | |
| 2006/0059618 | A1 | 3/2006 | Chung | |
| 2006/0120905 | A1 | 6/2006 | Kuo | |
| 2013/0198947 | A1* | 8/2013 | Yeung | A47K 3/064 4/559 |
| 2014/0246445 | A1 | 9/2014 | Lee et al. | |

FOREIGN PATENT DOCUMENTS

| | | | |
|---|---|---|---|
| EP | 0573230 | A1 | 12/1993 |
| WO | 9846489 | A1 | 10/1998 |

* cited by examiner

FOOTBATH APPARATUS

TECHNICAL FIELD

Various embodiments relate to an apparatus for bathing body parts, such as the feet or hands.

BACKGROUND

Many people experience foot problems at some time in their lives. This is not surprising, considering that people are employed in jobs that require them to be on their feet for large portions of the day. In fact, even an average day of walking can exert force equal to several hundred tons of pressure on the feet.

In an attempt to alleviate a variety of podiatric problems, bathing of the feet has become a recognized therapeutic method. For example, soaking soothes the feet and aids in recovery from fatigue. Bathing of the feet also stimulates the circulation of blood therethrough, which results in increased metabolism and excretion. In addition, footbathing facilitates the removal of painful growths such as calluses, bunions, and corns.

SUMMARY

In an embodiment, a footbath is provided with a base member defining a platform. A flexible continuous side wall extends from a proximal end region connected about a periphery of the base member to a distal end region. The side wall has a collapsed position and an extended position. The platform of the base member and the side wall cooperate to define a bath chamber for retaining water with the bath chamber sized to receive a body part. A retention member is supported by the base member to extend from the base member to the distal end region of the side wall to retain the side wall in the extended position.

In another embodiment, a footbath is provided with a housing with a platform. The housing provides a first slot on a first side thereof and a second slot on a second side thereof. A continuous side wall has a proximal end extending around a periphery of the platform and a distal end forming a lip. The side wall is moveable between a collapsed position with the proximal and distal ends of the side wall spaced apart a first distance and an extended position with the proximal and distal ends of the side wall spaced apart a second distance, with the second distance being greater than the first distance. The side wall cooperates with the platform to define a bath chamber sized to retain water and receive a body part in the extended position. A first bar has a first end region supported for translation within the first slot between a storage position wherein at least a portion of the first bar is received by the first slot in the storage position and a support position. The first bar extends from the first slot to the lip in the support position. The first bar has a second end region in selective engagement with the lip of the side wall to retain the side wall in the extended position. A second bar has a first end region supported for translation within the second slot between a storage position wherein at least a portion of the second bar is received by the second slot in the storage position and a support position. The second bar extends from the second slot to the lip in the support position. The second bar has a second end region in selective engagement with the lip of the side wall to retain the side wall in the extended position.

In yet another embodiment, a footbath is provided with a housing having a platform defining a series of apertures, the housing providing a slot. A continuous side wall has a proximal end extending around a periphery of the platform and a distal end forming a lip. The side wall defines at least one fold extending peripherally about an intermediate region of the side wall between the distal and proximal ends such that the side wall is moveable between a collapsed position and an extended position with the at least one fold unfolded. The platform and the side wall cooperate to define a bath chamber for retaining water when the side wall is in the extended position, with the bath chamber sized to receive a body part. A plurality of massage nodes are oriented on the platform. A bar has a first end region supported for translation within the slot between a storage position wherein at least a portion of the bar is received by the first slot in the storage position and a support position. The bar extends from the slot to the lip in the support position. The bar has a second end region in selective engagement with the lip of the side wall to retain the side wall in the extended position. An air pump is supported by the housing and is in fluid communication with the series of apertures in the platform to provide a flow of air to the series of apertures to provide a bubbling massage effect in the bath chamber. A heater is supported by the housing to heat a liquid within the bath chamber. A vibration module is supported within the housing.

DETAILED DESCRIPTION

Figure 1:
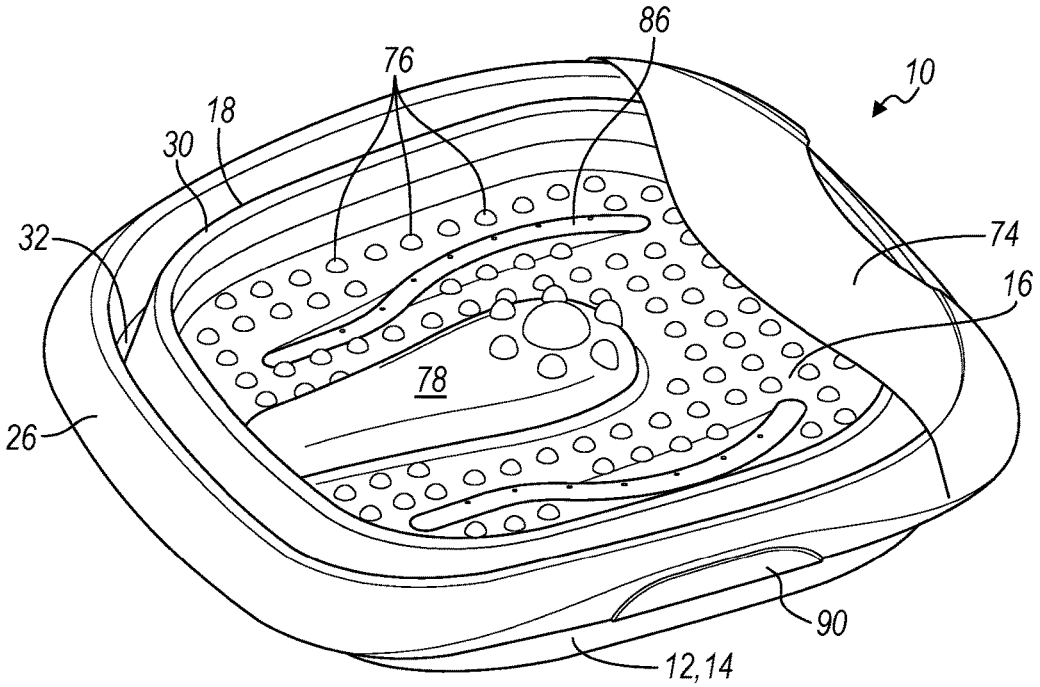
FIG. 1 is a top perspective view of a footbath apparatus according to an embodiment in a first position.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

FIGS. 1-5 illustrate a footbath apparatus 10 according to an embodiment of the present disclosure. The apparatus 10 may be used to provide therapy to a body part, such as a foot. The apparatus 10 may be generally constructed from a plastic material so as to be lightweight and portable, as well as durable, leak-proof, and corrosion resistant. Although the apparatus 10 is illustrated and described as being used in bathing and providing massage to the feet, the apparatus 10 may also be used for bathing and providing massage to other body parts, such as the hands.

The apparatus 10 has a housing 12 that includes a base member 14 that defines a platform 16. The housing 12 also has a continuous side wall 18. The side wall 18 extends circumferentially about the platform 16 and extends upwardly from the platform. The platform 16 may be generally parallel with an underlying support surface, or alternatively, the platform 16 may be slanted at an angle relative to the underlying surface and towards the user. The housing 12 and base member 14 may be formed from a plastic material, for example, via an injection molding process, and in one example is formed from a thermoplastic polymer or thermoset polymer that provides for a rigid structure, e.g. an ABS plastic or a similar material.

The side wall 18 cooperates with the base member 14 and the platform 16 to form a bath chamber 20. The bath chamber 20 has an associated length and width that accommodates the feet of an adult user, with sufficient space provided to permit a user to readily insert and remove their feet and to allow each foot to be moved somewhat while in position within the bath chamber 20. The bath chamber 20 is configured to contain a liquid, such as water, that is used for a therapy treatment.

Figure 2:
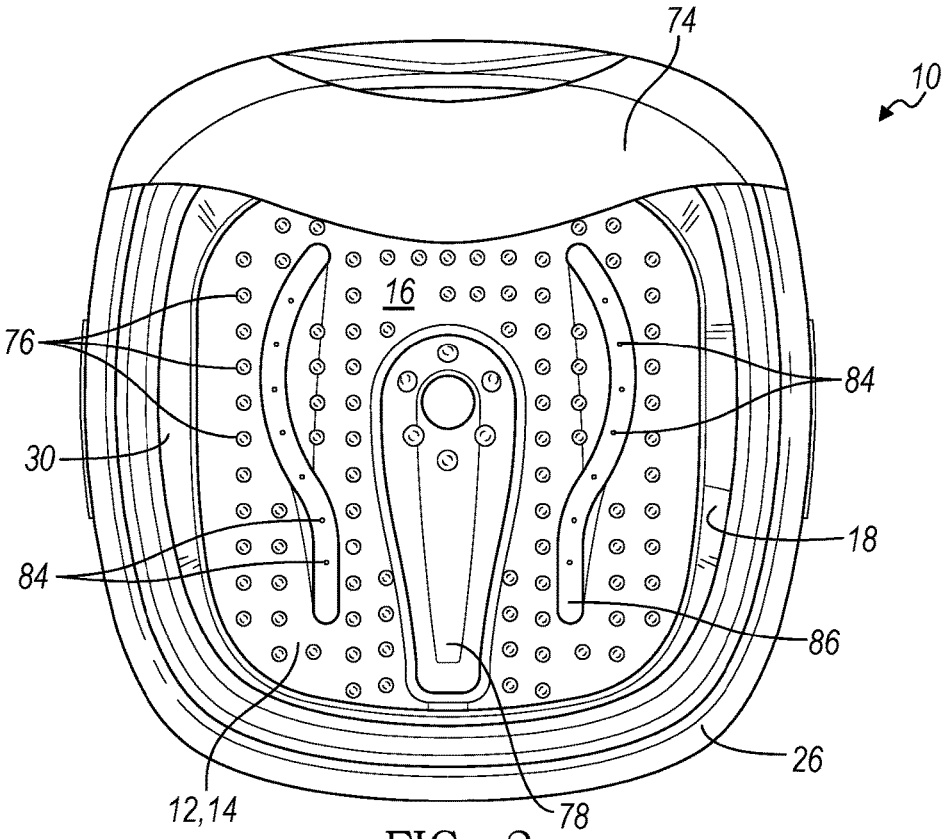
FIG. 2 is a top view of the footbath apparatus of FIG. 1.
Figure 3:
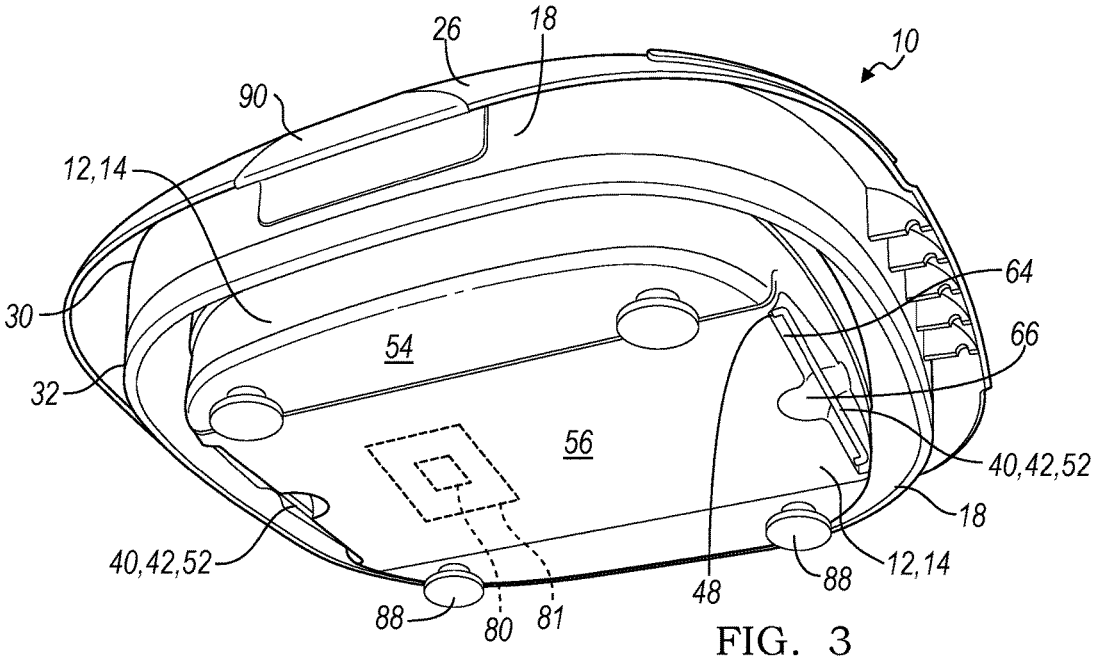
FIG. 3 is a bottom perspective view of the footbath apparatus of FIG. 1 in the first position.
Figure 4:
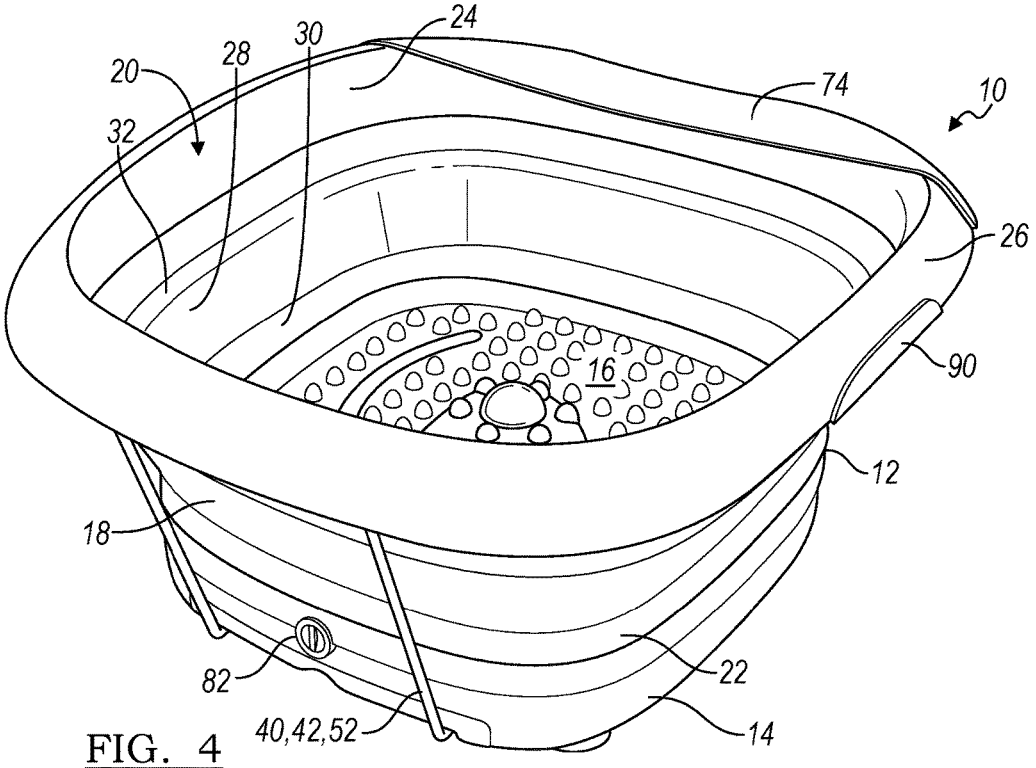
FIG. 4 is a top perspective view of the footbath apparatus of FIG. 1 in a second position.
Figure 5:
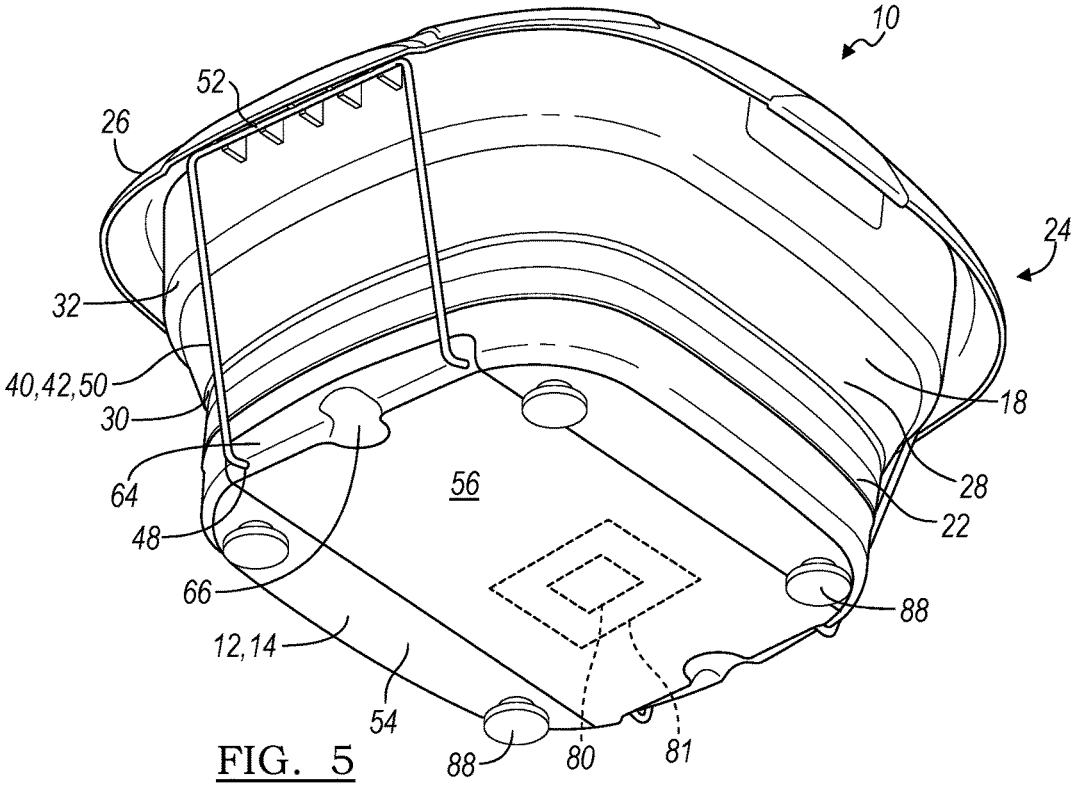
FIG. 5 is a bottom perspective view of the footbath apparatus of FIG. 4 in the second position.

The side wall 18 has a wall structure that is repeatedly collapsible and uncollapsible. The side wall 18 therefore has a first collapsed position, as shown in FIGS. 1-3, and a second extended position, as shown in FIGS. 4-5. In the collapsed position, the footbath apparatus 10 is in a configuration that provides for storage due to its smaller overall size. In the extended position, the footbath apparatus 10 forms the bath chamber 20 and may be at least partially filled with a liquid such as water such that a user may submerse their feet with a liquid level up to or above ankle height.

The side wall 18 has a proximal end region 22 that connects about a periphery of the base member. The side wall 18 also has a distal end region 24 that supports a lip 26 of the apparatus. At least a portion of the side wall 18 between the proximal and distal ends 22, 24 may be formed from a flexible material such that the side wall 18 may be folded. In one example, the distal end region 24, or the lip 26, is formed from a substantially rigid material, while the central region 28 or intermediate region of the side wall 18 is formed from a flexible material, thereby providing for both structural support and movability of the side wall 18. For example, distal end region 24 and/or the proximal end region 22 of the side wall 18 may be formed from a plastic material, for example, via an injection molding process, and in one example is formed from a thermoplastic polymer or thermoset polymer that provides for a rigid structure, e.g. and ABS plastic or a similar material. The intermediate region 28 is formed from a plastic, silicone, or rubber material that provides for a flexible structure, for example, via an injection molding or forming process, and in one example is formed from a thermoplastic polyurethane. In some examples, the distal end region 24 and/or the proximal end region 22 may also be formed from the same material as the intermediate region 28 of the side wall 18.

In the example shown, the side wall 18 has a first region that provides a first fold 30 or first fold section. The side wall 18 also has a second region that provides a second fold 32 or fold section. The first and second regions, or first and second folds 30, 32, each extend about a periphery of the side wall 18. In the collapsed position, the first and second regions or first and second folds 30, 32 are folded, as shown in FIGS. 1-3. In the extended position, the first and second folds 30, 32 are unfolded to lengthen the side wall 18, as shown in FIGS. 4-5. In other examples, the side wall 18 may have a single fold, more than two folds, an accordion-style collapsible structure, or another shape and structure that allows for collapsed and extended positions of the side wall.

In the collapsed position, the second fold 32 is positioned between the first fold 30 and the base member, as shown in FIGS. 1 and 3. In the extended position, the first fold 30 is positioned between the second fold 32 and the base member 14 as shown in FIGS. 4-5.

In the collapsed position, the side wall 18 has a first height or first distance between the proximal end region 22 and the distal end region 24. In the extended position, the side wall 18 has a second height or second distance between the proximal end region 22 and the distal end region 24. The second distance is greater than the first distance.

In the extended position, the side wall 18 is extended or lengthened, for example, via a pulling motion on the lip 26, such that the first and second folds 30, 32 are unfolded, and the footbath apparatus 10 moves from the configuration as shown in FIG. 1 to the configuration as shown in FIG. 4.

At least one retention member 40 is provided to maintain the side wall 18 in the extended position. In the example shown, the footbath apparatus 10 has two retention members 40; however, one retention member or more than two retention members are also contemplated for use with the apparatus 10. In a footbath apparatus 10 without a retention member 40, a downward force on the side wall 18 or the lip 26 of the side wall 18 may result in the side wall 18 collapsing. This may be undesirable when the bath chamber 20 contains a liquid and an inadvertent force is applied to the side wall 18, as it may cause the side wall 18 to collapse and liquid to spill out of the bath chamber 20 and onto an underlying surface. The retention members 40 according to the present disclosure prevent this inadvertent, undesirable collapse of the side wall.

The retention members 40 are supported by the housing 12 and the base member. Each retention member 40 has a first storage position as shown in FIG. 3, and a second retaining position or support position as shown in FIGS. 4-5.

In one example, the retention member 40 is provided by a support bar 42. Each support bar 42 is supported by the housing 12 and has a first end region 44 and a second end region 46. The first end region 44 is slidably supported within a first slot 48 defined by the housing 12. The second end region 46 is opposed to the first end region 44 and selectively engages the lip 26 of the side wall 18 to retain the side wall 18 in the extended position. Each support bar 42 is moveable between a storage position and a support position or retention position, with at least a portion of the support bar 42 being received by a respective slot 48 in the storage position. The support bar 42 extends from the first slot 48 to the lip 26 in the support position.

The support bar 42 may be provided as a U-shaped rod according to one example. The support bar 42 is shown as having first and second legs 50. The legs 50 may be generally parallel to one another. The end sections or legs 50 are connected to one another by an intermediate section, bridge section, or bridge 52. In another example, the apparatus 10 is provided with retention members 40 that are shaped as legs 50 alone, with the retention members 40 having a nonlinear bridge section, e.g. an M-shaped rod, or the like.

The first end region 44 of the support bar 42 is supported by the base member, such that the first end sections or legs 50 are slidably supported by the base member. The second end region 46 or bridge 52 cooperates with the distal end region 24 and lip 26 of the side wall 18 in the extended position to retain the side wall 18 in the extended position.

Figure 6:
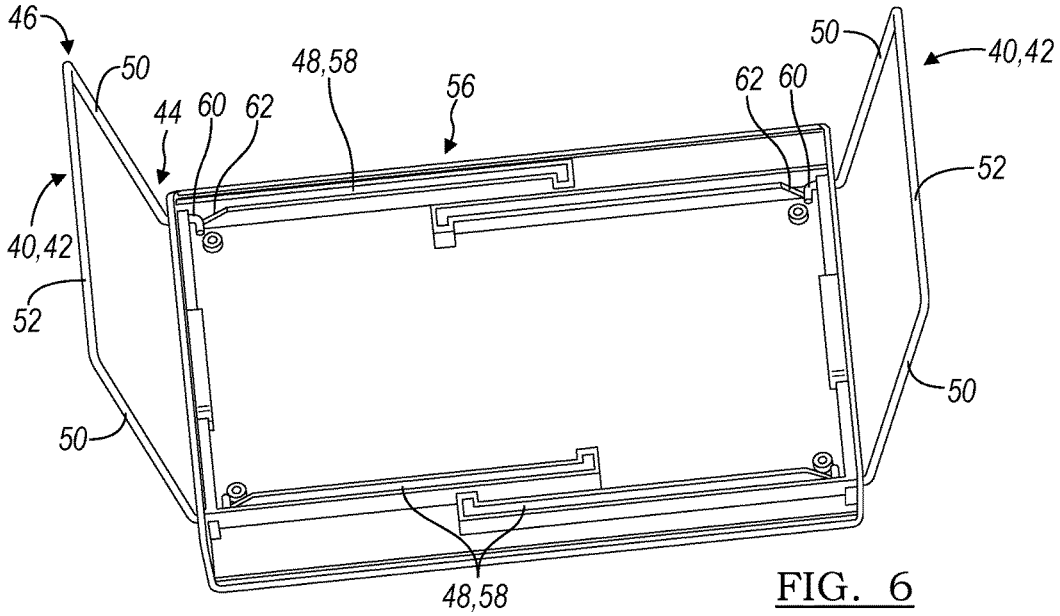
FIG. 6 is a perspective view of a guide and retention member assembly for use with the footbath apparatus of FIG. 1 according to an embodiment.

The base member 14 of the housing 12 defines a recess on the bottom surface 54, or the surface opposed to the platform 16. A cover plate 56 is provided over the recess and connected to the housing 12, and the cover plate 56 and support bars 42 are shown in FIG. 6. The recess and the cover plate 56 cooperate to define a guide such as a slot 48 for each of the retention members 40. The slot 48 is formed by the cover 56 positioned over the recess of the base member, with the recess and the cover 56 each defining at least one wall of the slot 48 and cooperating to form the slot 48. In other examples, the guide or slot 48 may otherwise be provided on the housing 12, for example, on a side region of the housing 12 generally below the side wall 18. In the example shown, the cover 56 defines channels 58 that are sized to receive the end sections of the support bar 42, and the wall of the recess defines the fourth wall that acts to enclose the channel 58 to form the slot 48 such that the slot 48 intersects a side of the housing 12. Each slot 48 is configured to slidably receive one of the end sections of a support bar 42.

Each end section of the support bar 42 may include a hook 60 or similar feature that allows the support bar 42 to rotate relative to the housing 12, and also prevents the support bar 42 from being completely removed and detached from the apparatus 10. The end of the guide channel 58 may include a tapered section 62 to facilitate the rotation of the support bar 42 relative to the housing 12.

The base member 14 also defines a groove 64 that extends between the pairs of slots 48. The groove 64 is sized to receive the intermediate section or bridge 52 of the support bar 42 when the support bar 42 is in the first storage position, as shown in FIG. 3. The groove 64 may have a varying width, as shown by the central region 66 of the groove 64, to facilitate a user grasping the support bar 42 to pull the support bar 42 out of the slots 48 for use in supporting the side wall 18.

In the first storage position, the support bar 42 is stored generally within the housing 12. The end sections or legs 50 extend in the guide channels and slots 48 such that the intermediate section 52 of the support bar 42 is in the groove 64. In the first storage position, at least a portion of the legs 50 are positioned within their respective slots 48, and a plane defined by the legs 50 and the bridge 52 of the support bar 42 is generally parallel with the platform of the housing 12.

In the second retaining position, the retention member 40 is configured to extend from the base member 14 to the distal end region 24 of the side wall 18 to retain the side wall 18 in the second extended position, as shown in FIGS. 4-5.

In the second retaining position, the support bar 42 extends from the base member 14 up to the distal end 24 and lip 26 of the side wall 18. The legs 50 of the support bar 42 each extend from the base member 14 up to the lip 26 of the side wall 18, and the bridge 52 of the support bar 42 cooperates with the distal end 24 and lip 26 of the side wall 18 to maintain the side wall 18 in the second extended position.

The end sections or legs 50 extend in the guide channels and slots 48 such that the intermediate section 52 of the support bar 42 is in the groove 64. In the first storage position, at least a portion of each leg 50 is positioned within a respective slot 48, and a plane defines by the legs 50 and the bridge 52 of the support bar 42 is generally parallel with the platform of the housing 12. In the second retaining position, a plane defined by the legs 50 and the bridge 52 of the support bar 42 is generally parallel with a surface of the adjacent extended side wall 18.

The first and second retention members 40 are spaced apart from one another to provide support at multiple locations around the periphery of the side wall 18. In the example shown, one retention member 40 is supported along a first side 70 of the base member, and the other retention member 40 is supported along a second opposed side 72 of the base member.

Additionally, the structure of the support bar 42 provides for an extended zone of support in the bridge 52 section of the support bar 42 along the lip 26, with the legs 50 spaced apart for stability.

To reconfigure the apparatus 10 from the collapsed position to the extended position, for example, to ready the apparatus 10 for use with a liquid, the user exerts a force on the lip 26 of the side wall 18 to cause the side wall 18 to extend, for example, by lifting the lip 26 and making the folded sections 30, 32 unfold. When the side wall 18 is in an extended position, the user may then grasp the bridge 52 of the support bar 42 and pull the support bar 42 outwardly away from the base section such that the legs 50 slide along or translate in the slots 48. When the hooks 60 reach the entrance to the slot 48 and the tapered sections 62, the support bar 42 may be rotated until the bridge 52 reaches the lip 26 of the side wall 18. The lip 26 may then be lifted and released over the bridge 52 of the support bar 42 such that the bridge 52 is nested within the lip 26 and the side wall 18 exerts a tension force downward on the support bar 42. The other support bar 42 may then be deployed in a similar manner to support the side wall 18 on both sides with a bath chamber 20 formed by the platform and the side wall 18, and the apparatus 10 in the second extended position.

To reconfigure the apparatus 10 from the extended position to the collapsed position, any liquid is removed from the bath chamber 20. The lip 26 is lifted slightly to release the bridges 52 of one or both support bars 42 from the lip 26. Each support bar 42 is rotated such that the bridge 52 moves away from the lip 26 of the side wall 18. When the support bar 42 is rotated such that the legs 50 are generally aligned with the slots 48, the hook 60 may act as a stop feature by contacting an internal wall of the recess and/or cover 56 to assist in the alignment. The user may then push and slide each support bar 42 into the slots 48 until the bridge 52 is within the groove 64. The side wall 18 may then be collapsed by exerting a force on the lip 26 of the side wall 18 to fold each fold section 30, 32 of the side wall 18.

A hood or splash guard 74 may be supported by the side wall 18, for example, along a section of the lip 26. The hood may at least partially cover the bath chamber 20. The hood may be integrally formed with the side wall 18, or may also be configured for other types of attachment, for example, a snap-fit or other releasable attachment. The hood may be constructed from a plastic material.

The platform 16 of the base member 14 has a surface defining a series of massage nodes 76 within the bath chamber 20. The platform may also define a raised section 78 that provides for additional placement of mechanical and/or electrical assemblies as described below within the base member, or to act as a partial fluid divider between regions sized for placement of the feet. The raised section 78 may define additional massage nodes for selective use by a user during treatment. The massage nodes may include a plurality of raised nodes as shown, ribs, or other contoured features. Of course, other shapes, sizes, and configurations of raised nodes are also contemplated. The raised nodes function to massage the feet upon contact, and also allow water and heat to flow under the feet to improve blood circulation.

The housing 12 and the base member 14 may house various mechanical and/or electrical assemblies, any and all of which are indicated generally as block 80 in FIG. 3, for the apparatus 10 within an internal compartment 81 formed within the base member 14. The internal compartment 81 is sized to receive the assemblies 80 and is sealed relative to the bath chamber. The housing 12 and base member 14 may house an assembly 80 that includes at least one of a vibration module, a heater, an air pump, a light or sound system, or other assemblies for use in therapy or operation of the apparatus 10. The compartment 81 is sealed to prevent the flow of liquid into the compartment 81 such that the assemblies 80 are kept dry.

The base member 14 and the recess may include a wall that forms the recess and also may form the surface 54. This wall acts to physically separate and provide a sealing barrier with the compartment 81 to prevent and liquid in the slots 48 or channels 58 from being able to flow into the compartment 81. Therefore, the slots 48 are provided on an outer surface of the base member 14 and may be formed or covered with a cover 56. The wall of the recess provides a barrier between the internal compartment 81 to prevent fluid flow from the slots 48 into the compartment 81, such that the slots are physically separated from the assemblies 80 in the compartment 81. Therefore, the retention members 48, which are movable components and draw fluid into the slots 48, are sealed from the compartment 81. By making the slots 48 separate from and on an outer surface of the base member 14, the compartment 81 may be easily sealed. As a liquid such as water is ever present during use of the apparatus 10, this configuration for the slots 48 is advantageous as it keeps the mechanical and electrical assemblies 80 in a sealed environment in the compartment 81.

The assemblies may be electrically powered, for example, via a cord connecting the apparatus 10 to a standard electrical outlet or using battery power. A user control panel 82 may be located on the housing 12, and include, for example, buttons or switches to power the apparatus 10 on and off. The user control panel may also control the various assemblies in the apparatus 10, for example to provide vibration of the apparatus, and to provide heat within the bottom region of the apparatus 10, or a combination of any of these functions. It is understood that other bath functions are contemplated, and the user control panel can include a greater number of switches. The switches may be standard push-push (push ON, push OFF) switches and may include a flexible, such as rubber, cover which provides a waterproof or water resistant design while being flexible to allow for depression of the underlying switch. As an alternative to a push-push type switch, the switches could be multi-function switches in order to allow for multiple modes of activation with every press. Additionally, it is contemplated that the user control panel could include a rotatable selector knob. An indicator light, such as an LED, could be provided on or adjacent to the switches to inform the user of the status or operating mode of the apparatus 10 or of a specific assembly.

The vibration module, indicated schematically as block 80, may be provided in the housing 12 and operated to impart vibration or a vibratory motion to the bath chamber 20 to provide a massaging effect to the feet. In one example, the vibration assembly may include a motor affixed underneath the platform, where the motor rotates an output shaft with a counterweight or eccentric weight attached thereto. When the motor is electrically powered in response to activation of the vibration switch by a user, vibrations are then transferred to the bath chamber 20 and the water contained therein to massage the feet. In some examples, the speed of the motor may be controlled to provide variable vibration intensities.

The heater, indicated schematically as block 80, may be provided in the housing 12 and operated to heat a liquid within the bath chamber 20 or to maintain a temperature of the liquid within the bath chamber 20. The heater may also provide heat to the foot surface when the foot is placed in the bath chamber 20 and on the platform. In one example, the heater is a resistive heating element, such as a rope heating element, secured underneath the platform and within the base member. The heater may be used to heat water in the bath chamber 20 to a desired or predetermined temperature, for example, when filling the bath chamber 20. The heater may also be used to maintain a temperature of the water in the bath chamber 20 and to prevent the water in the bath chamber 20 from cooling due to heat loss to the surrounding environment, for example, during operation of the apparatus 10.

The heater may conduct heat to the water in the bath chamber 20, such that the heated water relieves tired muscles and promotes circulation of the blood. In other examples, the heater may use infrared rays, that allow heat to penetrate deep underneath the surface of the skin, causing the pores of the skin to be opened and promoting metabolism and excretion of the body through increased blood circulation. The heater may be positioned at any location within the base member 14 for providing heat to the foot surface when the foot is placed thereon. Additionally, a portion of the platform may be translucent so as to allow for the function of the heater. Upon activation of the heater via depression of an associated switch, power is supplied to the resistive heating element or infrared lamps which provide infrared heat to a user's foot and the water in the bath chamber 20. The heater may also include a temperature control system, such that the heater automatically stops or starts when the temperature of the water crosses a threshold value. Other types of heaters are also contemplated.

An air pump, indicated schematically as block 80, may also be provided in the housing 12. The air pump may also be provided by a fan or another mechanism. The air pump is fluidly connected or pneumatically connected to a series of apertures 84 formed in the platform, for example, using tubing and various connectors within the base section. The air pump is configured to deliver pressurized air to the series of apertures to provide a bubbling massage effect in liquid contained in the bath chamber 20. In one example, the apertures are provided in the platform and are covered by bubble strips 86 or wave strips, which cause air flow exiting the apertures to provide bubbles in the water in the bath in specific regions and in specific dispersion patterns for interaction with the feet. Additionally, the apertures may have the same size or various sizes to further control the sir flow and bubbles into water contained in the bath chamber 20. The air pump and bubble massage feature may be activated upon powering on of the apparatus 10, or could be selectively powered via a switch on the user control panel. Although apertures are depicted herein as being disposed at selected locations of the platform, it is understood that other configurations of apertures within bath chamber 20 are also contemplated.

The housing 12 and base member 14 may also include feet 88 for supporting the apparatus 10 on the underlying surface. In one example, the feet are formed from a rubber or other material to prevent the apparatus 10 from moving relative to the underlying surface. The side wall 18 may also include handles 90 on the distal end region 24 or formed near the lip 26 that provide a graspable surface for the user to easily move the side wall 18 between the collapsed and extended positions, and vice versa.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A footbath comprising:

a base member defining a platform, the base member having a first side portion and a second opposed side portion;

a flexible continuous side wall extending from a proximal end region connected about a periphery of the base member to a distal end region, the side wall having a collapsed position and an extended position, the first side portion of the platform of the base member and the side wall cooperating to define a bath chamber for retaining water, the bath chamber sized to receive a body part;

a retention member supported by the base member to extend from the base member to the distal end region of the side wall to retain the side wall in the extended position, wherein the retention member comprises a support bar having a first end region and a second end region, the first end region supported by the base member, wherein the bar is received for translation within a slot in the base member, the bar having a first storage position with at least a portion of the bar positioned within the slot, and a second retaining position with the second end region contacting the distal end region of the side wall; and a cover positioned over a recess on the second side portion of the base member to collectively define the slot, the recess and the cover each defining at least one wall of the slot.

2. The footbath of claim 1 wherein the retention member is further defined as a first retention member; the footbath further comprising:

a second retention member supported by the base member to extend from the base member to the distal end region of the side wall to retain the side wall in the extended position, the second retention member spaced apart from the first retention member.

3. The footbath of claim 2 wherein the first retention member is supported by a first side of the base member, and the second retention member is supported by a second opposed side of the base member.

4. The footbath of claim 1 wherein the retention member comprises a support bar having first and second legs connected by a bridge, the first and second legs each supported by the base member, the bridge cooperating with the distal end region of the side wall in the extended position to retain the side wall in the extended position.

5. The footbath of claim 4 wherein the first and second legs are generally parallel with one another.

6. The footbath of claim 4 wherein the base member defines first and second slots, each slot receiving a respective one of the first and second legs of the support bar for translation therein;

wherein the retention member has a first storage position relative to the base member with the first and second legs positioned within the first and second slots, respectively;

wherein the retention member has a second retaining position relative to the base member with the first and second legs extending from the base member upwardly to the distal end region of the side wall and the bridge cooperating with the distal end region of the side wall to maintain the side wall in the extended position; and wherein, in positioning the retention member from the second retaining position to the first storage position, the first and second legs of the support bar pivot relative to the base member and subsequently slidingly translate within the first and second slots, respectively, until the bridge is adjacent to the base member.

7. The footbath of claim 6 wherein the base member defines a groove extending between the first and second slots, the groove sized to receive the bridge of the support bar in the first storage position.

8. The footbath of claim 6 wherein the first and second legs each form a hook in cooperation with the base member when the retention member is in the second retaining position.

9. The footbath of claim 6 wherein the support bar is generally parallel with a floor of the bath chamber when the retention member is in the first storage position, and the support bar is generally parallel with a surface of the extended side wall when the retention member is in the second retaining position.

10. The footbath of claim 1 wherein the base member defines an internal compartment sized to receive an assembly; and wherein a wall of the recess of the second side portion provides a barrier between the internal compartment and the slot to prevent fluid flow from the slot to the internal compartment.

11. The footbath of claim 10 wherein the assembly comprises at least one of a mechanical device and an electrical device.

12. The footbath of claim 10 wherein the assembly comprises at least one of a vibration module supported within the internal compartment, a heater supported within the internal compartment to heat a liquid within the bath chamber, and an air pump supported within the internal compartment and in fluid communication with to a series of apertures formed by the base member in the bath chamber to deliver pressurized air to the series of apertures to provide a bubbling massage effect in the bath chamber.

13. The footbath of claim 1 wherein the proximal end region and the distal end region are spaced apart by a first distance in the collapsed position;

wherein the proximal end region and the distal end region are spaced apart by a second distance in the extended position; and wherein the second distance is greater than the first distance.

14. The footbath of claim 1 wherein the side wall is formed from a flexible material that defines a first fold section and a second fold section extending peripherally about the side wall, whereby the first and second fold sections unfold when the side wall is in the extended position.

15. The footbath of claim 14 wherein the second fold section is positioned between the first fold section and the base member in the collapsed position of the side wall; and wherein the first fold section is positioned between the second fold section and the base member in the extended position of the side wall.

16. A footbath comprising:

a housing with a platform, the housing providing a first slot on a first side thereof and a second slot on a second side thereof;

a continuous side wall with a proximal end extending around a periphery of the platform and a distal end forming a lip, the side wall moveable between a collapsed position with the proximal and distal ends of the side wall spaced apart a first distance and an extended position with the proximal and distal ends of the side wall spaced apart a second distance, the second distance greater than the first distance, the side wall cooperating with the platform to define a bath chamber sized to retain water and receive a body part in the extended position;

a first bar with a first end region supported for sliding translation along the first slot and pivotal motion relative to the housing between a storage position wherein at least a portion of the first bar is received by the first slot in the storage position and a support position, the first bar extending from the first slot to the lip in the support position, and with a second end region in selective engagement with the lip of the side wall to retain the side wall in the extended position; and a second bar with a first end region supported for sliding translation along the second slot and pivotal motion relative to the housing between a storage position wherein at least a portion of the second bar is received by the second slot in the storage position and a support position, the second bar extending from the second slot to the lip in the support position, and with a second end region in selective engagement with the lip of the side wall to retain the side wall in the extended position.

17. The footbath of claim 16 wherein the proximal end and the distal end of the side wall comprise a first, rigid material; and wherein the intermediate region of the side wall comprises a second, flexible material.

18. A footbath comprising:

a housing with a platform defining a series of apertures, the housing providing a slot;

a continuous side wall with a proximal end extending around a periphery of the platform and a distal end forming a lip, the side wall defines at least one fold extending peripherally about an intermediate region of the side wall between the distal and proximal ends such that the side wall is moveable between a collapsed position and an extended position with the at least one fold unfolded, the platform and the side wall cooperating to define a bath chamber for retaining water when the side wall is in the extended position, the bath chamber sized to receive a body part;

a plurality of massage nodes oriented on the platform;

a bar with a first end region supported for sliding translation along the slot and pivotal motion relative to the housing between a storage position wherein at least a portion of the bar is received by the slot in the storage position and a support position, the bar extending from the slot to the lip in the support position, and with a second end region in selective engagement with the lip of the side wall to retain the side wall in the extended position;

an air pump supported by the housing and in fluid communication with the series of apertures in the platform to provide a flow of air to the series of apertures to provide a bubbling massage effect in the bath chamber;

a heater supported by the housing to heat a liquid within the bath chamber; and a vibration module supported within the housing.

19. The footbath of claim 18 wherein the first end region of the bar defines a hook, the hook configured to allow the bar to rotate relative to the housing, and configured to interact with the housing to prevent the support bar from becoming detached from the housing.

20. The footbath of claim 19 wherein the slot of the housing is defined by a guide channel, an entrance to the guide channel having a tapered section configured to interact with the hook of the bar to facilitate rotation between the storage position and the support position; and wherein the hook of the bar is configured to contact an internal wall of the guide channel to align the bar with the slot to facilitate sliding translation of the bar within the slot.

* * * * *